United States Patent [19]

Krinsky

[11] 4,211,236

[45] Jul. 8, 1980

[54] ORTHOPEDIC CUSHION AND METHOD FOR FITTING THEREOF

[76] Inventor: Martin S. Krinsky, 545 Saratoga Ave., Santa Clara, Calif. 95050

[21] Appl. No.: 963,906

[22] Filed: Nov. 24, 1978

[51] Int. Cl.[2] ..... A61F 5/14

[52] U.S. Cl. ..... 128/594

[58] Field of Search ..... 128/595, 594, DIG. 20, 128/581

[56] References Cited

U.S. PATENT DOCUMENTS

| | | | |
|---|---|---|---|
| 2,177,116 | 10/1939 | Persichino | 128/594 |
| 3,121,430 | 2/1964 | O'Reilly | 128/595 |
| 3,903,621 | 9/1975 | Dubner | 128/595 X |
| 3,929,140 | 12/1975 | Wesberg | 128/595 |

*Primary Examiner*—John D. Yasko

*Attorney, Agent, or Firm*—Phillips, Moore, Weissenberger, Lempio & Majestic

[57] ABSTRACT

An orthopedic cushion, both fittable as well as fitted, for a portion of a user's body such as a user's foot, and a method for fitting thereof. The fittable orthopedic cushion comprises a flexible envelope containing a flowable, highly viscous material. The envelope includes an elongated member and a diverticulum which may receive part of the viscous material during adjustment of the cushion to comfortably accommodate the portion of the user's body. The elongated member and diverticulum of the fittable cushion may be sealed off from the envelope and removed, resulting in a fitted orthopedic cushion, the envelope of which will contain a desired amount of the viscous material.

17 Claims, 7 Drawing Figures

ORTHOPEDIC CUSHION AND METHOD FOR FITTING THEREOF

BACKGROUND OF THE INVENTION

1. Field of the Invention

This invention relates to orthopedic cushions, and particularly to the manner by which they are fittable to a particular user's body.

2. Prior Art

The occurrence and variety of orthopedic problems, particular podiatric problems, for human beings are legion. Among the orthopedic problems are those incurred by amputees or by athletes. In general, many orthopedic problems may be met by assisting in the padding provided by the body's natural fatty pads, and by re-establishing stability of the particular body portion.

For example, a padding assistance function of podiatric cushions aids in reducing the concentrations of weight on pressure points produced by bones in the foot, and is particularly desirable for patients with conditions such as diabetes, peripheral neuropathy and fat atrophy.

Also, a podiatric cushion's function of re-establishing foot stability is particularly desirable for those persons who have a tendancy to cock the foot sideways to the ground, due to a bone spur or congenital deformity such as metatarsus varus.

Various types of pads, orthopedic footwear inlays and the like, are known in the art which are intended to more comfortably accomodate a portion of a user's body, such as the foot of persons encountering foot problems. For example, U.S. Pat. No. 3,548,420 discloses a cushion structure which is filled with a viscous gel.

However, fitting of the previously known orthopedic structures, particularly foot wear inlays and the like, to accomodate the particular problem areas for an individual have not been found satisfactory. Two United States patents, U.S. Pat. No. 4,063,562 and U.S. Pat. No. 3,765,422, disclose structures which attempt to solve the problem of proper fitting and confirmation of a podiatric insole by providing directional slits or walls within podiatric insoles for directing portions of the insole contents to particular areas of a wearer's foot. However, such directional devices within podiatric insoles are designed to meet generalized foot problems rather than being specifically adapted for the foot problem of the individual.

Another approach to fitting footwear support pads to a foot is disclosed by U.S. Pat. Nos. 3,914,881 and 2,123,730, which discloses that liquid may be injected into particular pad structures by means such as a hypodermic needle. The seal obtained after such injection is, however, subject to possible leaking and generally constitutes the weakest portion of such pad structures. Such leaking can damage shoes and clothing, as well as serving as an inconvenience and requiring visits to a podiatrist to replace failed cushions.

Thus, the prior art structures or fitting methods for orthopedic cushions have not been found fully satisfactory and have generally required the use of specialized tools by the attending physician.

Accordingly, the present invention is designed to provide an orthopedic cushion which is individually adjustably fittable to a portion of a user's body, especially when the user is a podiatric patient with particular foot problems, without the use of specialized tools by the treating podiatrist, and which cushion, once fitted to a user's foot, provides sturdy, comfortable accomodation to and support of the foot with a minimal chance of leakage from the cushions. Finally, the present invention provides a method whereby a person, such as a podiatrist, may accurately and precisely fit an orthopedic cushion to a patient without the use of specialized tools such as hypodermic needles or the like.

SUMMARY OF THE INVENTION

In one sense, the present invention provides an orthopedic cushion which is useful for fitting to a portion of a user's body. The fittable orthopedic cushion comprises a flexible envelope and an elongated member outwardly extending therefrom. A diverticulum opens off of the elongated member. The interiors of the envelope, elongated member, and the diverticulum are under partial vacuum. Within the envelope is a flowable, highly viscous material.

In another sense, the invention provides a method for fitting an orthopedic cushion to an orthopedic patient's body comprising placing a flexible envelope containing a vacuum packed, highly viscous material therein against the patient's body, adjusting the amount of the viscous material within the envelope, and shifting the adjustment means to close the envelope.

Finally, the invention discloses an orthopedic cushion, such as the fittable orthopedic cushion above-described, which has been fitted to an orthopedic patient's body, such as by fitting method of the present invention.

DETAILED DESCRIPTION OF THE PREFERRED EMBODIMENTS

The orthopedic cushion of the present invention is herein described, for convenience, as a podiatric cushion useful for fitting or fittable to a user's foot. However, it should be understood that the orthopedic cushion is not limited to such podiatric use.

Figure 1:
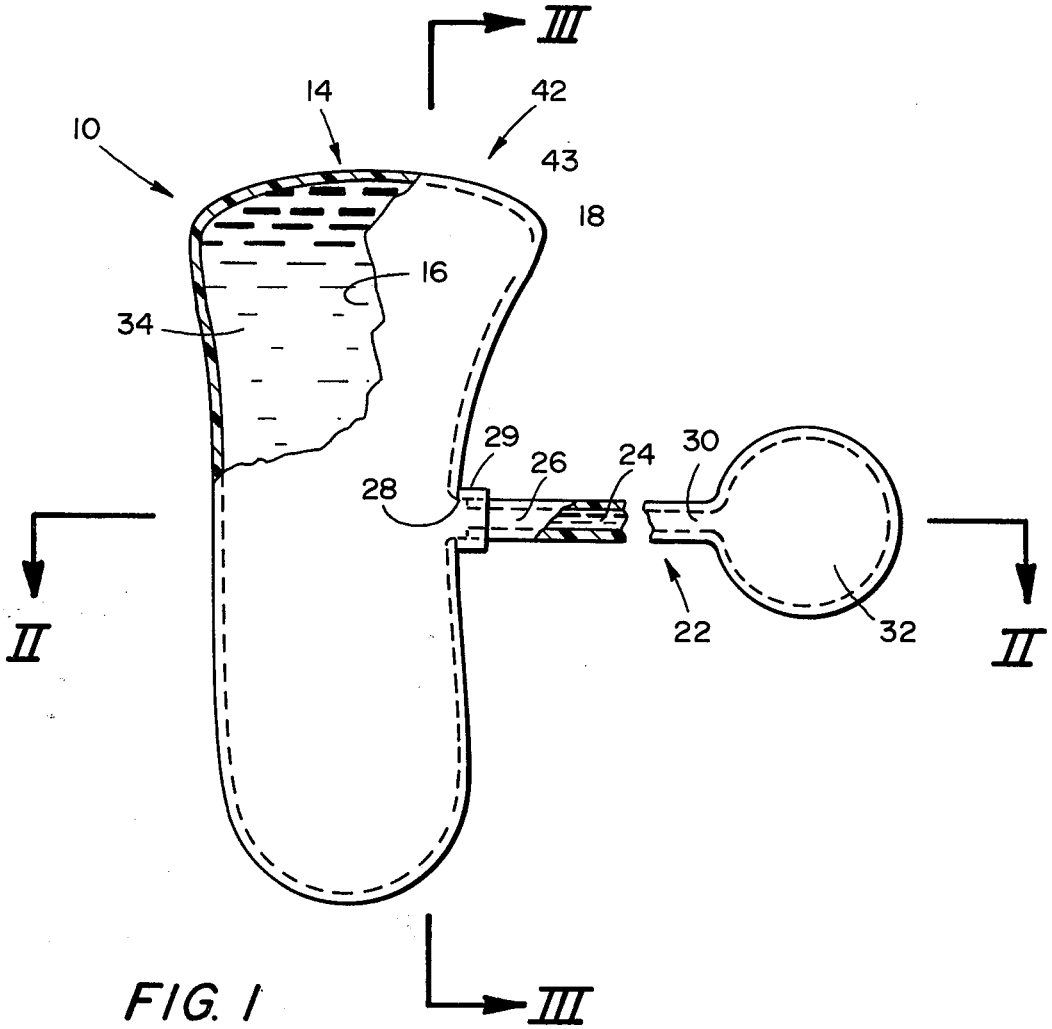
FIG. 1 is a top view, with portions in phantom, and portions partially broken away in section, of a cushion of the present invention.
Figure 3:
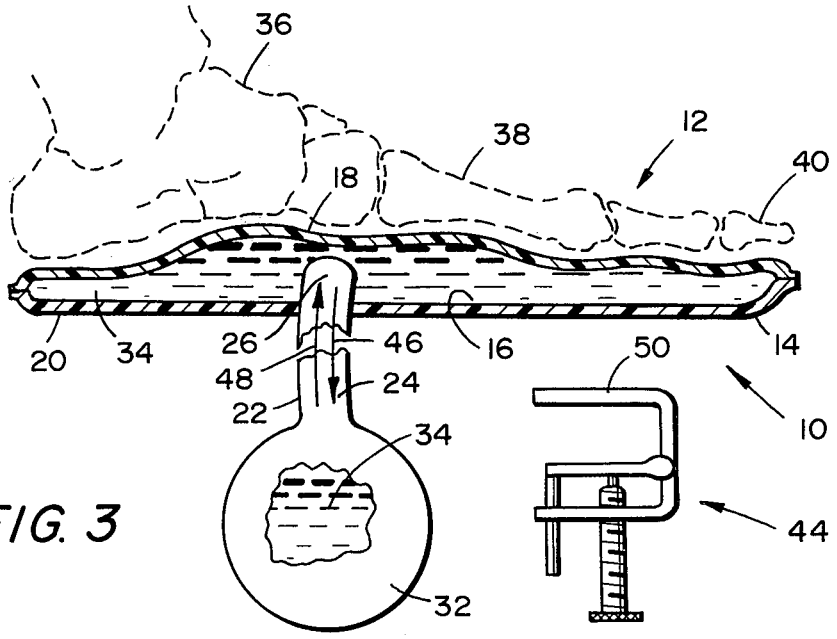
FIG. 3 is a side view, with a portion in perspective, taken along lines III—III of FIG. 1.

Referring to FIGS. 1 and 3, a podiatric cushion 10 is provided which is useful for fitting to a user's, or podiatric patient's foot 12 (illustrated in FIG. 3).

The cushion 10 comprises an envelope 14 which conforms generally in outline to the foot 12 and which defines an interior volume 16. As herein used throughout, the interior volume 16 is defined to mean the cubic space enclosed by envelope 14, wherein the maxiumum volume of interior volume 16 being that space where the envelope 14 is fully filled, but wherein volume 16 may vary due to the flexibility of envelope 14. Envelope 14 is formed of a flexible material such as various plastics, for example polyvinyl chloride film or sheeting, or polyester film. The flexible material should be of sufficient thickness to provide durable and rugged wear properties for envelope 14. For example, a thickness of about 2 to about 12 mil when using polyvinyl chloride film has been found sufficient.

Envelope 14 may be formed through processes of heat sealing or laminating two layers 18,20 of film or sheeting together, wherein interior volume 16 is formed therebetween. The general foot-like outline of envelope 14 may be formed by conventional methods such as by configuring an envelope sealing die (not illustrated) in the appropriate size and shape.

Flexible envelope 14 includes an elongated member 22 which extends peripherally outwardly from one side of envelope 14. In podiatric use, the member 22 would normally extend from adjacent the foot's instep for ease of adjustment and comfortable use of the cushion 10. With this construction, the cushion 10 can be placed in a shoe and the foot 12 placed thereover while the member 22 proceeds upwardly along the side of the foot 12 and out of the shoe adjacent the inner portion of the ankle joint. Elongated member 22 includes a passageway 24 therethrough, the passageway 24 is narrow in cross-sectional dimension with respect to a cross section of envelope 14, as is best illustrated by FIG. 2.

Passageway 24 communicates at one end 26 with the envelope interior volume 16. Elongated member 22 may be formed of a material the same as or similar to flexible envelope 14. However, elongated member 22 is preferably formed of a flexible plastic with a thickness somewhat greater than that used for envelope 14, and elongated member 22 may be joined to envelope 14 by heat sealing, epoxy glue or the like. Communication of passageway 24 to interior volume 16 may be achieved by an orifice 28 formed in the envelope 14, the orifice 28 receiving elongated member 22. The orifice 28 may include an annular extrusion 29 for encirclement by or about elongated member 22 to aid in assemblage.

Opening off of the passageway 24 at the passageway other end 30 is a diverticulum 32. The particular shape of diverticulum 32 may vary; however, the interior of diverticulum defines a void space, hereinafter simply referred to as diverticulum 32, with a transverse dimension usually larger than passageway 24. Diverticulum 32 may be formed from materials and by processes such as have been described for flexible envelope 14.

Figure 2:
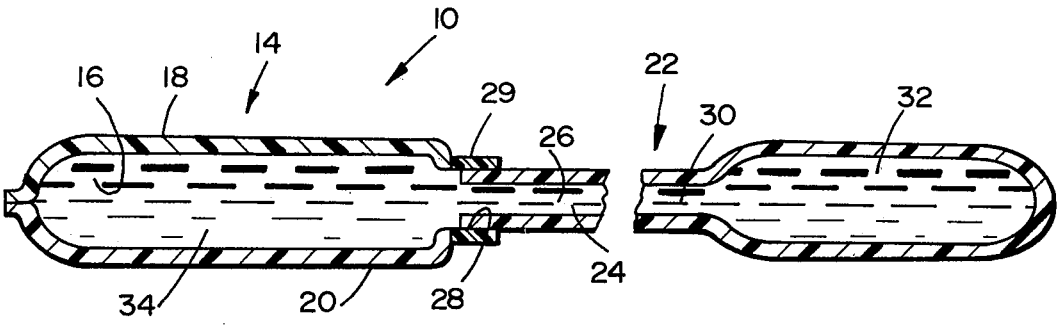
FIG. 2 is a side, cross-sectional view, taken along lines II—II of FIG. 1.

As may best be seen in FIG. 2, interior envelope volume 16, passageway 24 and diverticulum 32 together define substantially contiguous surfaces wherein the interior envelope volume 16 and the diverticulum 32 are in communication one with the other along narrow passageway 24.

The cushion 10 further comprises a flowable, highly viscous material 34 within the envelope volume 16 and, as hereinafter described, along the passageway 24.

This viscous material 34 preferably is of sufficient viscosity to re-establish stability of the wearer's foot, to disperse weight upon any one problem area, and to reduce shear forces placed upon the foot 12. The shear forces are created, for example, during a normal stride, where the foot displays a forward rocking action, the first pressure being upon the heel, and subsequent pressures moving forwardly as the foot comes down. Patients with diseases such as diabetes, peripheral neuropathy, and fat pad atrophy frequently require additional support beneath the foot. Accordingly, it is very important that the viscous material 34 as closely as possible match the flow of the foot's fat padding below the tarsus 36, metatarsals 38, and phalanges 40 (illustrated in FIG. 3).

It has been found that the viscosity of the viscous material 34 most suitable in matching the flow of the foot's padding is from about 300 to about 1200 poise, more preferably of about 500 poise. Thus, it is essential that the viscous material 34 remains flowable and does not set within the envelope 14. Suitable materials for example, are various silicone rubber polymers available from suppliers such as General Electric or Dow Corning. Silicone rubbers are particularly desirable in that they are stable substances which provide a long, useful life for the orthopedic cushion 10, and they are also inert so that a user of the cushion 10 does not incur skin damage should the silicone rubber escape from envelope 14.

Additionally, it is very desirable that substantially no air bubbles be present in the viscous material 34 within envelope volume 16 as such bubbles cause discomfort for the user. Accordingly, the diverticulum 32, the passageway 24, and the envelope volume 16 are preferably all under partial vacuum (e.g., reduced atmospheric pressure) to a sufficiently negative pressure with respect to atmospheric pressure that air bubbles do not form between the envelope interior surface and the viscous material, or along the passageway 24.

Turning to FIG. 1, during assembly of the podiatric cushion 10, after the envelope 14, the elongated member 22 and the diverticulum 32 have been formed and are in assemblage, as above described, an opening, illustrated by arrow 42, may be left for packing of the viscous material 34 therein. Packing of the viscous material 34 may be by vacuum packing processes, which processes have evacuated interior volume 16, passageway 24, and diverticulum 32 and have degassed the viscous material 34. The viscous material 34 received through the opening arrow 42, may then be sealingly closed, the seal 43 indicated in FIG. 1. The total volume, or amount, of viscous material 34 therein packed is of a predetermined amount which will, if entirely within the envelope volume 16, be greater than needed for the user's comfort. The predetermined amount of viscous material 34 will usually exceed the maximum possible interior volume 16; however, a predetermined amount of viscous material 34 which is somewhat less than the maximum possible interior volume 16 may be utilized so long as envelope 14 is overfilled with respect to a user's comfort. The over-fill of viscous material 34 in envelope 14 results in communication of the viscous material 34 along the passageway 24, and into the diverticulum 32, as illustrated by FIG. 2.

Turning to FIG. 3, the cushion 10 preferably also comprises means 44 for adjusting the amount of viscous material within the envelope volume 16 to a desired amount, wherein the desired amount is less than the predetermined amount of viscous material 34. Adjusting means 44 is preferably associated with the elongated member 22 to permit intermittant flow interruption of viscous material 34 along the passageway 24, the flow illustrated by arrows 46 and 48. The adjusting means 44 may comprise, for example, a section of the passageway 24 which is made of an elastomeric material and is normally elastomerically biased shut, but which can be opened by squeezing in a direction orthogonal to the biasing direction (not illustrated), such sections being conventionally known and used as parts of pipetting bulbs in the transfer of radioactive fluids; or, adjusting means 44 may simply comprise a clamp member 50, disposable about elongated member 22 and adjacent the passageway two ends 26,30 wherein clamp member 50 may be alternatively opened and closed to open and close communication of the viscous material 34 between the envelope interior volume 16 and the diverticulum 32 along the passageway 24 while a person, such as a podiatric patient, shifts weight upon the cushion 10 until the desired (comfortable) amount of viscous material 34 is within the envelope volume 16, and the cushion 10 comfortably accomodates the foot 12.

Figure 4:
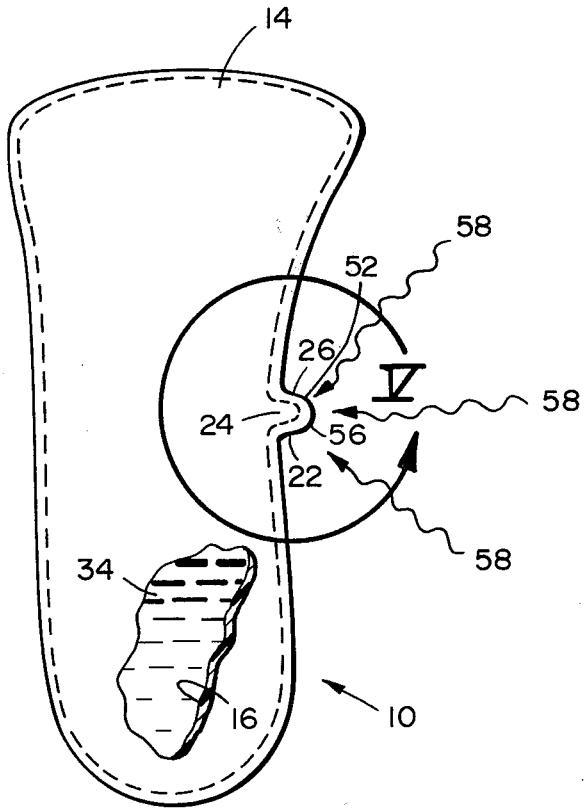
FIG. 4 is a top view, with portion in phantom and portions in section, broken away, of an embodiment of the present invention.
Figure 5:
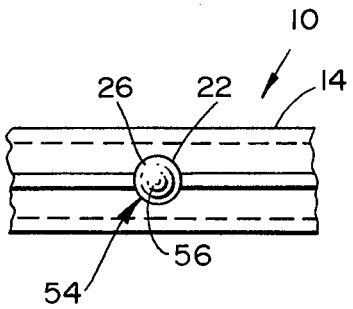
FIG. 5 is an enlarged, side view taken along an area of V of FIG. 4.

Turning to FIGS. 4 and 5, when the podiatric cushion 10 has been fitted to a podiatric patient's foot, the elongated member is truncated, or pinched off, and the envelope 14 is sealed for a fitted podiatric cushion 10. The fitted cushion 10 comprises the flexible envelope 14 within which is contained a desired amount of vacuum packed, flowable, viscous material 34, the desired amount being less than the packed, predetermined amount of the viscous material 34 as previously described. The fitted cushion 10 includes a truncated portion 52, carried by the envelope 14, the truncated portion 52 being the stub-like remnant of the elongated member 22, and sealing means 54 for sealing the truncated portion 52, and for closing the passageway 24. The truncated portion 52, when included in a podiatric cushion, will normally be quite short with respect to its outward protrusion from the envelope 14, and will normally be positioned adjacent the user's insole, so that no interference with the user's comfort is incurred.

Referring to FIGS. 4 and 5, sealing means 54 preferably comprises a radio frequency seal 56 formed by compression combined with radio frequency wave bombardment 58 of elonaged member 22, usually closely adjacent the passageway one ene 26. The radio frequency seal 56 is advantageous in providing a seal which is at least as strong as the envelope 14. Thus, viscous material 34 is secured against leaking from envelope 14 either from an inadequate seal or bursting of envelope 14 at the radio frequency seal 56.

Figure 6:
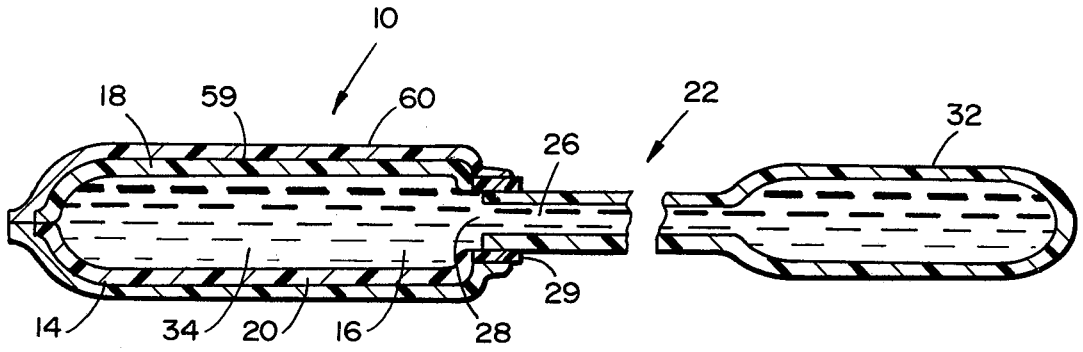
FIG. 6 is a side, cross-sectional view, similar to FIG. 2, of an alternate embodiment of the present invention.

Referring to FIG. 6, another embodiment of the present invention is illustrated wherein the orthopedic cushion 10, either fittable (as illustrated) or fitted, comprises a double envelope, the first envelope being envelope 14, and a second envelope 60. Second envelope 60 provides a back-up barrier for the viscous material 34 in the event that envelope 14 is breached after long periods of use. An interstice 59 between envelope 14 and second envelope 16 is under a partial vacuum to prevent air bubbles forming therebetween. Second envelope 60 completely encloses envelope 14, and preferably is formed of a flexible material the same as or similar to that of envelope 14. Second envelope 60 may be sealed to envelope 14 along orifice 28 adjacent annular extrusion 29.

Figure 7:
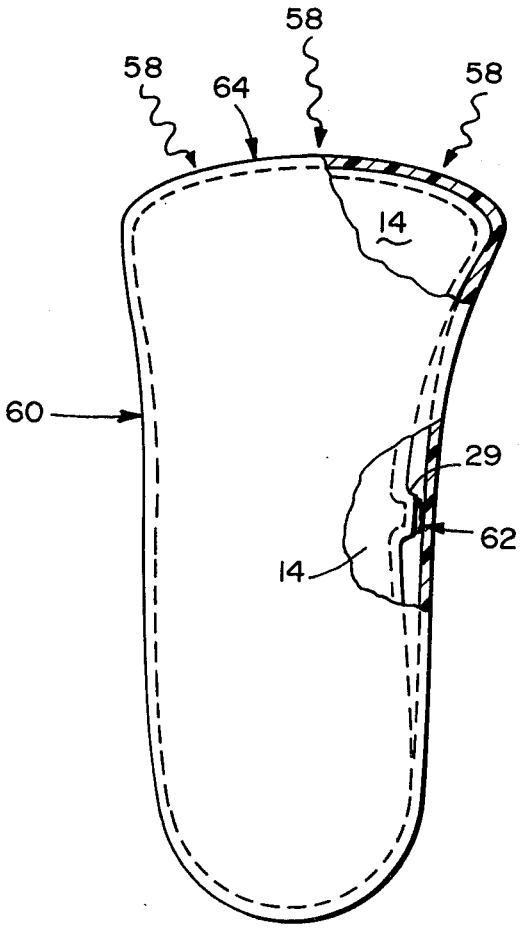
FIG. 7 is a top view, partially broken away in section, of a second alternate embodiment of the present invention.

FIG. 7 illustrates a particularly preferred embodiment wherein the elongated member 22 is cut off and left open as at 62 after adjustment of the viscous material 34 between envelope 14 and diverticulum 32 for comfort and appropriate use of adjusting means 44. Care should be taken to avoid loss of the material 34 from the envelope 14. The envelope 14, open at 62, is then placed within second envelope 60, which is at that time open at a region 64 removed from the position of opening 62 within second envelope 60. With the envelopes 14 and 60 thus positioned, the region 64 is sealed, as by rf bombardment as indicated at 58 and generally with evacuation of the interior of second envelope 60 to insure that no air bubbles are formed therein which might cause user discomfort. When sealing is performed in an area removed from the opening 62, none of the viscous material 34 is present at the seal whereby a considerably stronger seal is obtained.

Method

Referring to FIG. 3, a method of fitting a podiatric cushion to a podiatric patent's foot is provided which comprises the steps of placing, adjusting and shifting as described in the following.

A flexible envelope, such as envelope 14 above described, containing an overfill of vacuum packed, highly viscous material, such as viscous material 34, is placed against a portion of a patient's body where padding is desired. The flexible envelope 14 has an adjustable releasing orifice, for example the combination of passageway 24 and clamp member 50, which is adjustable between a releasing and receiving position, arrows 46 and 48, and a closed position, for permitting adjustment of the viscous material 34 into and out of envelope 14.

The amount of viscous material 34 is adjusted within the envelope 14 through the orifice as the patient shifts weight upon the body portion where padding is desired until the cushion comfortably accomodates the body portion. The adjustable orifice is then shifted to its closed position.

The method of fitting further preferably comprises sealing the envelope 14 adjacent the orifice, illustrated by FIGS. 4 and 5, wherein the sealing may comprise bombarding the orifice with radio frequency waves, illustrated as 58, wherein a rugged seal 56 results in an envelope with a desired amount of viscous material to provide comfortable accomodation of the patient's foot. When, for example, the adjustable releasing orifice comprises the passageway 24 clamped shut, or closed, by the clamp member 50, the excess viscous material 34 is primarily contained within the diverticulum 32. The person fitting the cushion may then simply send the clamped, fitted cushion to a location providing radio frequency sealing services whereupon the envelope 14 may be permanently sealed with the desired amount of viscous material therein, and the excess material in the remaining diverticulum may be reused for another purpose or another orthopedic cushion. Alternatively, sealing may proceed as with the FIG. 6 or FIG. 7 embodiments, with the latter embodiment leading to the strongest seal.

In summary, an orthopedic cushion which is useful for fitting to a user's body, a method of fitting an orthopedic cushion to an orthopedic patient's body, and an orthopedic cushion which is fitted to an orthopedic patient's body is provided. The orthopedic cushion of the present invention provides an individualized, fitted cushion containing the specifically desired amount of viscous material suitable for assisting in padding of the body for the particular user which is rugged and safe during prolonged use.

What is claimed is:

1. An orthopedic cushion, useful for fitting to a user's foot or against other portions of a user's body, comprising:

a unitary structure including:

a flexible envelope, the envelope defining an interior volume;

an elongated member outwardly extending form the envelope, the elongated member including a narrow passageway communicating at one end with the envelope interior volume; and a diverticulum, the diverticulum opening off of the passageway at the passageway other end and being spaced outward of the flexible envelope and away from that portion of the envelope against which the user's foot or other portions of the user's body will bear, the diverticulum, the passageway, and the envelope volume all under partial vacuum; and a non-set and flowable, highly viscous material, the viscous material of a predetermined amount overfilling the envelope volume and within the passageway.

2. The orthopedic cushion as in claim 1 further comprising:

adjusting means for selectively opening and closing the passageway to adjust the relative amounts of material between the envelope volume and the diverticulum.

3. The orthopedic cushion as in claim 2 wherein the elongated member is flexible and wherein the adjusting means comprises clamp means, exteriorally disposable about the elongated member and adjacent the passageway between the two ends, the clamp means serving for interrupting the communication of the passageway with the envelope interior volume.

4. The orthopedic cushion as in claim 2 wherein the adjusting means comprises elastomeric biasing means, disposed within the passageway and normally biased to a closed position for permitting communication of the passageway with the envelope interior volume when compressed.

5. The orthopedic cushion as in claim 2 wherein the viscous material has a viscosity from about 300 to about 1200 poise.

6. The orthopedic cushion as in claim 5 wherein the viscous material has a viscosity of about 500 poise.

7. An orthopedic cushion, useful for fitting to a user's foot or against other portions of a user's body, comprising:

a unitary structure including:

a flexible double envelope with a first envelope and a second envelope, the first envelope defining a first interior volume, the first envelope enclosed by the second envelope;

an elongated member outwardly extending from the double envelope, the elongated member including a narrow passageway communicating at one end with the first interior volume; and a diverticulum, the diverticulum opening off of the passageway other end and being spaced outwardly of the double envelope and away from that portion of the double envelope against which the user's foot or other portions of a user's body will bear, the diverticulum, the passageway, and the first envelope volume all under partial vacuum; and a non-set and flowable, highly viscous material, the viscous material of a predetermined amount overfilling the first envelope volume and within the passageway.

8. The orthopedic cushion as in claim 7 further comprising:

adjusting means for opening and closing the passageway to adjust the relative amounts of material between the first envelope volume and the diverticulum.

9. An orthopedic cushion fitted to an orthopedic patients body comprising:

a unitary structure including:

a flexible envelope, the envelope defining an interior volume;

an elongated member outwardly protruding from the envelope, the elongated member including a narrow passageway in communication with the first envelope volume at a passageway one end and being spaced outward of the flexible envelope and away from that portion of the envelope against which the patient's body will bear; and sealing means for sealing the elongated member at a point spaced from the passageway one end, the sealing means fixidly interrupting the envelope volume communication with the passageway and closing the passageway; and a non-set and flowable, highly viscous material contained within the envelope volume, the viscous material having been vacuum packed therein, the contained viscous material in an amount less than the vacuum packed amount.

10. The orthopedic cushion as in claim 9, wherein the sealing means comprises:

a radio frequency seal.

11. An orthopedic cushion fitted to an orthopedic patient's body comprising:

a unitary structure including:

a flexible double envelope with a first envelope and a second envelope, the first envelope defining a first interior volume, the first envelope enclosed by the second envelope;

an elongated member outwardly protruding from the double envelope, the elongaged member including a narrow passageway in communication with the first envelope volume at a passageway one end and being spaced outward of the double envelope and away from that portion of the envelope against which the patients body will bear; and sealing means for sealing the elongated member at a point spaced from the passageway one end, the sealing means fixedly interrupting the envelope volume communication with the passageway and closing the passageway; and a non-set and flowable, highly viscous material contained within the envelope volume, the viscous material having been vacuum packed therein, the contained viscous material in an amount less than the vacuum packed amount.

12. The orthopedic cushion as in claim 11 wherein the sealing means comprises:

a radio frequency seal.

13. An orthopedic cushion fittable to an orthopedic patient's body, comprising:

a unitary structure including:

a first flexible envelope defining an interior volume and having an opening therethrough at a first peripheral region thereof; and a second fully sealed flexible envelope completely enclosing said first envelope and substantially matingly fitting thereabout, said second envelope having been sealed about said first envelope by a seal formed at a peripheral region of said second envelope removed from said opening through said first envelope; and a non-set and flowable highly viscous material within and fully filling said interior volume.

14. The cushion as in claim 13, wherein said seal is a radio frequency seal.

15. A method of fitting an orthopedic cushion to an orthopedic patient comprising the steps of:

placing a flexible envelope containing a vacuum packed, highly viscous non-set material therein against a portion of a patient's body where padding is desired, the flexible envelope having an adjustable releasing orifice for the viscous material communicating therewith, the orifice shiftable between a releasing and receiving position and a closed position, the orifice communicating with a diverticulum which is spaced outward of the flexible envelope and away from that portion of the envelope against which the portion of the patient's body will bear;

adjusting the amount of the viscous material within the envelope through the orifice responsive to the patients shifting weight against the body portion where padding is desired until said cushion comfortably accomodates said body portion; and, shifting the releasing orifice to its closed position.

16. The method of fitting an orthopedic cushion as in claim 15 further comprising:

sealing the orifice into its closed position.

17. The method of fitting an orthopedic cushion as in claim 16, wherein the sealing comprises:

bombarding the envelope adjacent the orifice with radio frequency waves.

* * * * *